US010100570B1

(12) United States Patent
Ortega et al.

(10) Patent No.: US 10,100,570 B1
(45) Date of Patent: Oct. 16, 2018

(54) THRESHOLD GASKET ASSEMBLY

(71) Applicants: Larry Ortega, Houston, TX (US); Tracy Bowling, Houston, TX (US)

(72) Inventors: Larry Ortega, Houston, TX (US); Tracy Bowling, Houston, TX (US)

(73) Assignee: Tejas Specialty Group, Inc., Houston, TX (US)

( * ) Notice: Subject to any disclaimer, the term of this patent is extended or adjusted under 35 U.S.C. 154(b) by 0 days.

(21) Appl. No.: 15/470,682

(22) Filed: Mar. 27, 2017

(51) Int. Cl.
*E06B 1/04* (2006.01)
*E06B 1/70* (2006.01)
*E06B 1/62* (2006.01)
*E06B 1/66* (2006.01)

(52) U.S. Cl.
CPC ..... *E06B 1/70* (2013.01); *E06B 1/62* (2013.01); *E06B 1/66* (2013.01); *E06B 2001/628* (2013.01)

(58) Field of Classification Search
CPC ..... E06B 1/62; E06B 1/66; E06B 1/68; E06B 2001/628; E06B 2001/622; E06B 2001/707; E06B 1/70; E06B 1/705; E06B 7/2312; E06B 7/2316
USPC ..... 52/211, 58, 60, 204.5, 204.54, 204.53, 52/504.56, 396.04, 393, 214; 49/475.1, 49/506, 470
See application file for complete search history.

(56) References Cited

U.S. PATENT DOCUMENTS 2,188,815 A 1/1940 Murphy
3,448,543 A * 6/1969 Multer ..... E06B 7/2312 49/470
4,006,562 A * 2/1977 Belanger ..... E06B 7/2314 49/380
4,310,991 A * 1/1982 Seely ..... E06B 1/70 49/470
5,046,292 A 9/1991 Sampson
5,056,263 A * 10/1991 Bies ..... E06B 7/2312 49/470
5,168,669 A * 12/1992 Knapp ..... E06B 7/2316 49/470
5,174,065 A * 12/1992 Schlicht ..... E06B 7/2312 49/470
5,222,345 A * 6/1993 Riley ..... E06B 1/702 52/716.1
5,377,464 A * 1/1995 Mott ..... E06B 1/62 52/213

(Continued)

OTHER PUBLICATIONS

M-D Building Products, Inc., Online Catalog, Shaped Replacement Door Bottom with Vinyl Fins—36 inches—2016, Oklahoma City, OK.

(Continued)

*Primary Examiner* — Chi Q Nguyen
(74) *Attorney, Agent, or Firm* — Crain, Caton & James

(57) ABSTRACT

The present invention is a threshold gasket assembly to be used in conjunction with end and/or back dams to form a sill pan. The threshold gasket assembly is fixed to a lower region of a rough opening in a wall and comprises a base with a plurality of fins projecting away from base to form a corresponding plurality of channels with a length generally the same as a base. Base has a generally "L" shaped cross section. At least two fins are sufficiently spaced from another to prevent contact with each other thereby simultaneously ensuring that moisture is dammed by at least one fin and directed by at least a portion of an adjacent channel.

5 Claims, 4 Drawing Sheets

(56) References Cited

U.S. PATENT DOCUMENTS 5,438,380 A * 8/1995 Muramatsu ..... G03B 17/24 396/316
5,553,419 A 9/1996 Jenkins
5,921,038 A * 7/1999 Burroughs ..... E04B 1/7046 49/408
6,374,545 B1 * 4/2002 Baczuk ..... E06B 7/23 49/470
6,385,925 B1 5/2002 Wark
6,651,402 B2 * 11/2003 Grunst ..... B05C 17/00516 52/309.5
6,901,707 B2 * 6/2005 Smerud ..... E06B 1/006 52/204.53
7,797,884 B2 * 9/2010 Allen ..... E04F 13/06 52/211
8,443,554 B1 5/2013 Teodorovich
8,726,575 B1 * 5/2014 Vulpitta ..... E06B 7/22 49/470
9,032,668 B2 * 5/2015 Blackwood ..... E06B 7/2305 49/475.1
2005/0011140 A1 1/2005 Ackerman
2005/0102964 A1 * 5/2005 Grunst ..... B05C 17/00516 52/741.1
2009/0271089 A1 * 10/2009 Sekimoto ..... F02D 41/009 701/103
2012/0079771 A1 * 4/2012 Meulemans ..... E06B 7/2305 49/484.1
2013/0283717 A1 * 10/2013 Smith ..... E04F 19/063 52/465

OTHER PUBLICATIONS

Lorient Polyproducts, Online Catalog, Acoustic Door Seal and Smoke Seal, 2016, Newton Abbot, United Kingdom.
Reddiseals, LTD., Online Catalog, Weatherbar Plus Door Threshold Flipper Seal, 2017, Droitwich, Worcestershire, United Kingdom.

* cited by examiner

THRESHOLD GASKET ASSEMBLY

CROSS-REFERENCES TO RELATED APPLICATIONS

None

STATEMENT REGARDING FEDERALLY SPONSORED RESEARCH OR DEVELOPMENT

Not Applicable

THE NAMES OF THE PARTIES TO A JOINT RESEARCH

Not Applicable

REFERENCE TO A SEQUENCE LISTING

Not Applicable

BACKGROUND OF THE INVENTION

(1) Field of the Invention

The present invention relates to materials used in the construction, or repair of a threshold in a wall or roof; and in particular materials used between a sill of a door, window, or skylight and a substrate or foundation for the purpose of eliminating or at least reducing the incursion of water and/or moisture across the lower region formed in a wall or roof.

(2) Background of the Invention

Without some type of seal, flashing, sill pan, or a combination thereof, water and/or moisture will enter a building through windows, doors, skylights and other apertures in a wall or roof. Doors, windows, and skylights are usually installed using either a barrier system or a drained system. Barrier installations tend to be poor at preventing water infiltrations through and around door, window, and skylight openings. Such installations are limited to areas of low rainfall potential or areas where the area is protected—such as under a porch. Drained installations are designed to manage water infiltration through and around the opening for a door, window, or skylight by collecting and draining the water to the exterior. Such collection and draining is traditionally carried out by a pan flashing.

A properly designed and installed pan flashing is fixed below a door, window, or skylight to perform the functions of collecting and directing water that may leak through or around the rough opening back out to the exterior. A properly designed and installed pan flashings should: (1) include a durable, continuous water barrier surface without holes, tears, or wrinkles that could retain water in the opening; (2) the pan flashing has a back dam or positive slope to direct water to the outside of the wall; (3) the pan flashing has end dams at the sides to prevent water from moving to the outside of the wall; and (4) the pan flashing laps over the drainage plane beneath the opening.

Traditionally, pan flashings are constructed on site or manufactured and then brought to the site for installation. For wood framed openings, a pan flashing can be constructed on site from self-adhered flashing membrane, self-adhered formable flashing, non-water sensitive sheet metal, certain liquid-applied waterproof members, or a combination thereof. Manufactured pan flashings can be of a fixed or variable width to span the width of the lower region of a rough opening in a wall. ASTM E2112-07 sets out the recommended standard practice for installation of exterior windows, doors and skylights. ASTM E2112-07 classifies sill pan flashings as Type I (rigid sheet—metal or plastic), Type II (rigid sheet—multiple metal or plastic pieces), Type III (flexible membrane—self adhering flashing), Type IV (combination—rigid and membrane flashing) and Type V (liquid—membrane coating). Furthermore, sill pan flashings can be designed and installed to be concealed or direct drain.

Type I sill pans are usually made from rigid sheets of metal or plastic and can be one-piece, or constructed from multiple pieces welded or soldered watertight. Type II sill pans are constructed from similar materials as found in a Type I sill pan, but construction includes solid pre-formed corners lapped and sealed, or joined to a solid center section with a watertight seal. Type III sill pans are constructed from a flexible membrane. Type III sill pans can be one-piece or multiple pieces—where each piece is lapped watertight. Type IV sill pans are a combination of rigid and membrane flashing—wherein pre-formed rigid corners are lap joined with membrane sheets. Type V sill pans are one piece but are created by applying a liquid coating directly to the substrate, foundation or a combination thereof.

Type I and II sill pans, whether constructed on-site or off-site, must be of the correct dimensions to fit the opening in the wall (or roof). On-site fabrication of a proper fitting Type I or II sill pan requires a laborer with a high level of skill. Off-site pre-formed Type I and II sill pans such as disclosed in U.S. Pat. No. 6,385,925 for a Window Drain; and U.S. Pat. No. 5,553,419 for a Door Threshold Assembly must be manufactured in a variety of widths and lengths to meet the needs of the building and repair industries. Furthermore, such pre-formed off-site Type I and II sill pans can be damaged while being stored at the construction site or shortly after installation (but before installation of the window, door, or skylight). Damage usually occurs to the small upturned lip also known as the back dam. Additionally, adjustable multi-piece Type I sill pans, as disclosed in U.S. Pat. No. 8,443,554 for a Variable Size Door and Window Sill Pan with Drain require a greater degree of skill and care in configuring the length and width of the continuous water barrier surface across the lower region of the rough opening. Careless cutting and/or snapping of excess material off the water barrier surface increases the likelihood of cracking, holes or a combination thereof thereby allowing water to be retained in the lower region of the rough opening.

Type III sill pans that are one piece share the same limitations as a Type I sill pan. The same can be said for Type III sill pans fabricated from multiple pieces. The installation of a Type III sill pan does not require the same amount of skill required to properly install a Type I or II sill pan, but the bending and forming of the flexible membrane to the shape of the rough opening increases the likelihood of holes, tears or wrinkles that overtime retain water in the opening.

Proper installation of a type V sill pans require skilled labor to prepare the surfaces and pour the liquid membrane coating to a uniform thickness. Furthermore, the appropriate liquid membrane coating must be selected to ensure proper membrane thickness and bonding to the rough opening substrate (or foundation).

Current sill pan designs, materials, fabrication and installation techniques do not satisfy the needs of the building and repair industries. More specifically, current sill pan designs are expensive to fabricate and install; require skilled labor; and/or fail to meet the collection and/or direction functions described above.

Given these shortfalls and problems, there is a need for an improved sill pan to collect and direct water that is easy to install by unskilled labor.

BRIEF SUMMARY OF THE INVENTION

The present invention is a threshold gasket assembly to be used in conjunction with end and/or back dams to form a sill pan. In a preferred embodiment, a threshold gasket assembly is part of a sill pan that meets or exceeds the requirements of a ASTM Type IV sill pan. The object of the present invention is to provide the building and repair industries: (1) a low cost, easily installed pre-formed threshold gasket assembly that simultaneously collects and directs water in an effective and positive manner to the exterior of an opening; and (2) provides a seal, dam, and channel system between a sill and a lower region of a rough opening irrespective of the shape or contour of the sill assembly's lower region. Furthermore, the current invention minimizes the number of components and tools required for installation.

The novel threshold gasket assembly preferably includes a plurality of flexible fins extending from an upper surface of a base having a generally "L" shaped cross section. The plurality of fins forms a corresponding plurality of channels. The plurality of fins and plurality of channels dam, collect, and direct water, moisture, or a combination thereof away from a space interior to the rough opening. The length and width of a base is defined by a user and generally dictated by the width and depth of a lower region of a rough opening in wall or ceiling. Adjacent fins are spaced and/or have a length as not to touch each other when deflected, thereby simultaneously ensuring that a deflected fin functions as a dam, and at least a portion of an adjacent channel remains to direct water, moisture, or a combination thereof to at least one end of a threshold gasket assembly.

DETAILED DESCRIPTION OF THE PREFERRED EMBODIMENTS

Figure 1:
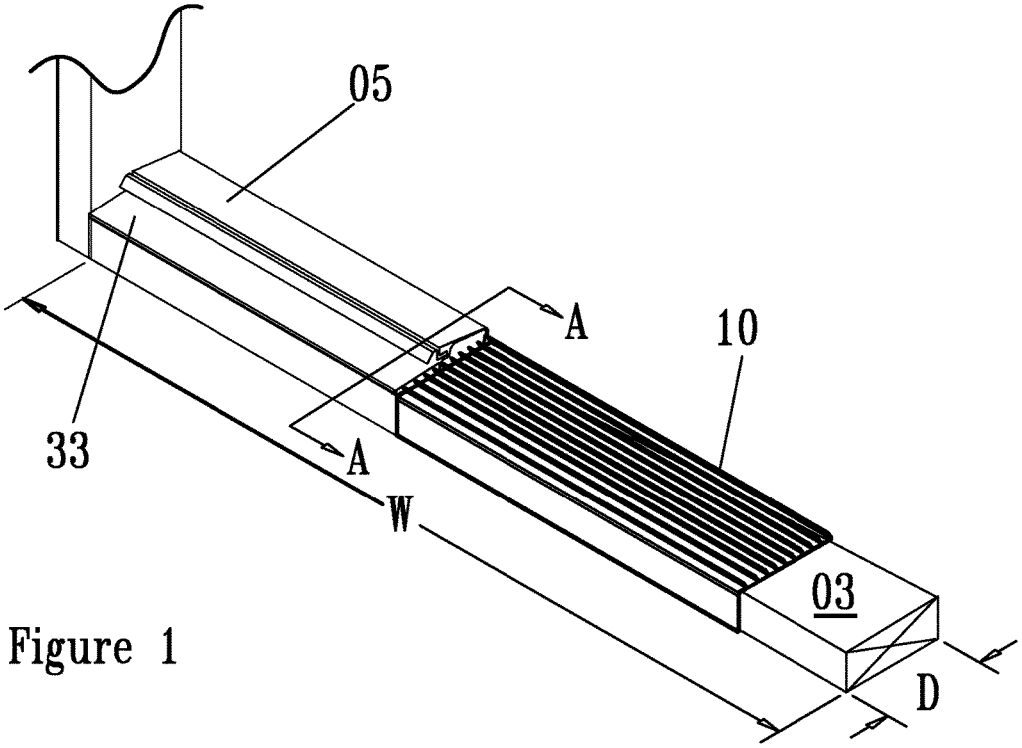
FIG. 1 is an isometric cutaway view of a novel threshold gasket assembly installed in a rough opening in a wall depicting a threshold gasket assembly between a sill assembly and a foundation.
Figure 2:
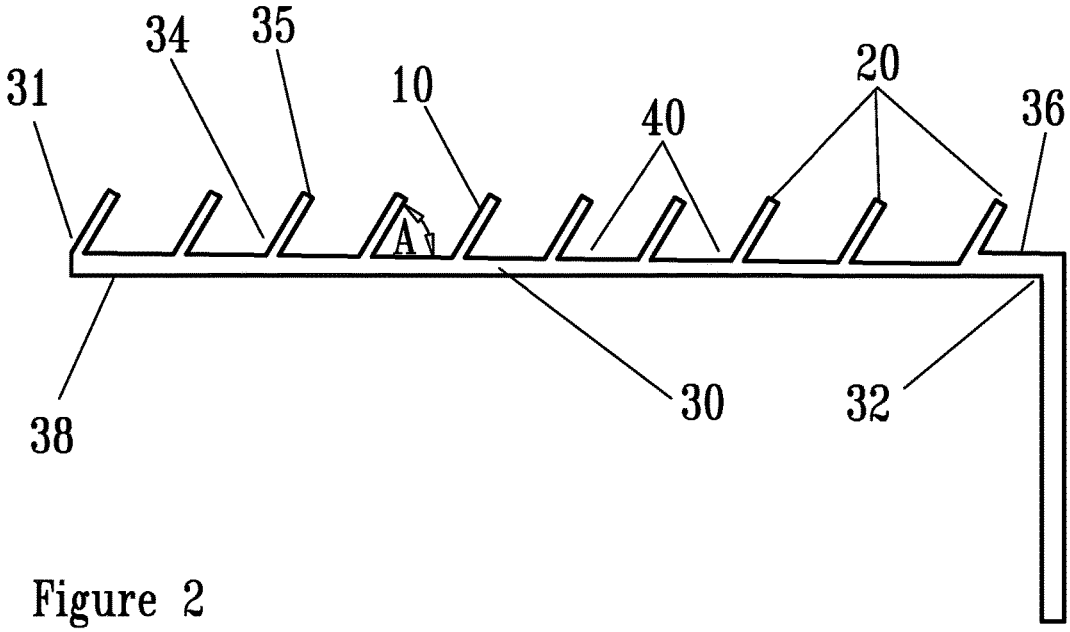
FIG. 2 is an elevation view of a novel threshold gasket assembly with a plurality of angled fins extending from a base with a generally "L" shaped cross section.
Figure 3:
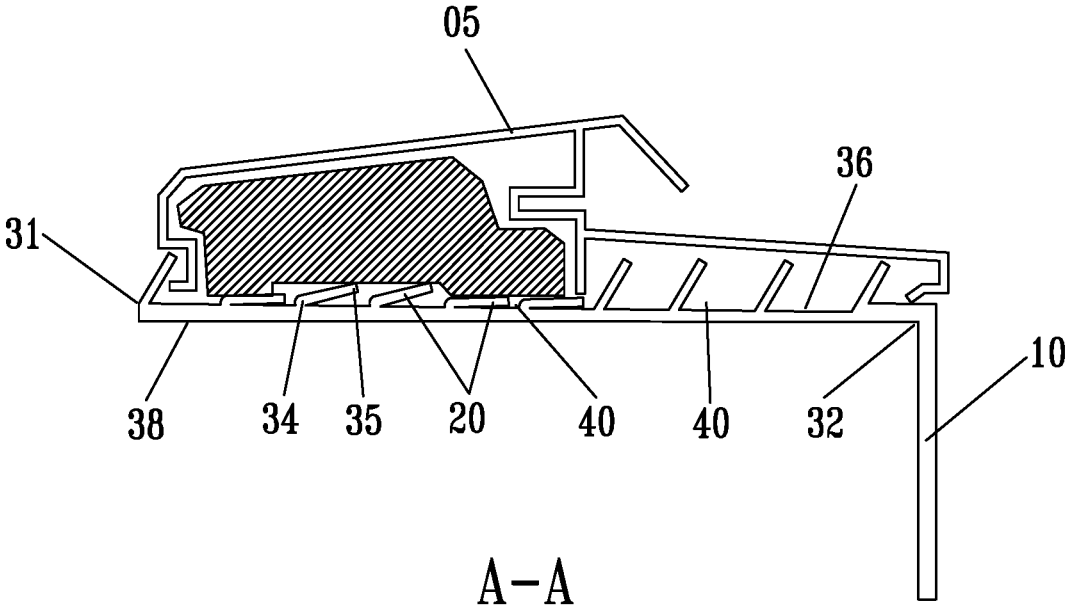
FIG. 3 is an elevation cross sectional view of a sill assembly and novel threshold gasket assembly with a plurality of angled fins extending from as well as deflected towards a base with a generally "L" shaped cross section.

Referring to FIG. 1, the present invention is a threshold gasket assembly 10 fixed to a lower region of a rough opening in a wall. In another embodiment, a threshold gasket assembly 10 is fixed to a periphery of a rough opening in a roof. Threshold gasket assembly 10 includes a base 30 with a back region 31 proximal to an space interior to rough opening; opposing end regions 33 proximal to corresponding ends of a rough opening; and a plurality of fins 20 projecting away from base 30 to form a corresponding plurality of channels 40 on an upper surface 36 of base 30. See FIGS. 1 through 6. Both fins 20 and channels 40 have lengths generally the same as base 30. In a preferred embodiment, fins 20, channels 40 or a combination thereof are parallel to a longitudinal axis of a base 30. See FIG. 1. Base 30 has a generally "L" shaped cross section. At least two of said plurality of fins 20 are sufficiently spaced from another to prevent contact with each other, thereby simultaneously ensuring that water and/or moisture is dammed by at least one fin 20 and directed by at least a portion of an adjacent channel. See FIG. 3. In another embodiment, at least two fins 20 have different heights above base 30. See FIG. 5.

Base 30 is manufactured from a durable material that is at least water resistant, and preferably waterproof. It is contemplated that in a preferred embodiment, base 30 is constructed from a durable material that is also resilient, such as, but not limited to elastomer rubber compounds, thermoplastic elastomer compounds, butyl compounds, chloroprene compounds, ethylene-propylene compounds, epichloro hydrin compounds, fluorocarbon compounds, fluorosilicone compounds, isoprene compounds, natural rubber compounds, nitrile compounds, silicone compounds, or a combination thereof. In a preferred embodiment, base 30 is extruded from a durable resilient material source such as fluorosilicone rubber compounds or fluorocarbon rubber compounds. In another embodiment, base 30 is molded from a durable material source such as ethylene propylene rubber compounds.

In a preferred embodiment, base 30 has a generally "L" shaped cross section. See FIGS. 1-6. The long portion of the "L" shaped base 30 sits on a foundation 03 at a lower region of a rough opening in a wall. See FIG. 1. In another embodiment, the long portion of the "L" shaped base 30 sits on a frame located at a periphery of a rough opening in a roof. The short portion of a "L" shaped base 30 is in contact with a generally vertical surface of a foundation 03 at a lower region of a rough opening in a wall. See FIG. 1. In another embodiment, the short portion of the "L" shaped base 30 is in contact with a generally vertical surface of a frame located at a periphery of a rough opening in a roof. It is further contemplated that foundation 03 could be a component of a wall or a floor. Foundation 03 could be constructed from a material, such as, but not limited to wood, metal, concrete, or a combination thereof, that is adversely effected by moisture and/or water. Fixture of a threshold gasket assembly 10 to a foundation 03 is preferably accomplished by an adhesive disposed between lower region 38 of base 30 and foundation 03. It is contemplated that an adhesive could be applied to the long portion of the "L" shaped base 30, the short portion of the "L" shaped base 30, corner 32, or a combination thereof). In one embodiment, an adhesive layer is applied to a lower region 38 of base 30 prior to installation of a threshold gasket assembly 10 to a foundation 03. In another embodiment, an adhesive layer is applied to foundation 03 prior to installation of a threshold gasket assembly 10. In yet another embodiment, an adhesive layer is applied to both a lower region 38 of base 30 and foundation 03 prior to installation of a threshold gasket assembly 10. In yet another embodiment, prior to a threshold gasket assembly 10 being installed to a foundation 03, an adhesive layer is applied between a lower region 38 of base 30 and a release liner, preferably before shipment to a construction site.

It is contemplated that thickness of a base 30 may range from approximately 1/32 of an inch to and including approximately 3/4 of an inch. In a preferred embodiment, base 30 has a uniform thickness of approximately 1/8 of an inch. Depth of a base 30 (measured from corner 32 to end of back region 31) is user defined but generally depends primarily upon a depth of a lower region of a rough opening in a wall ("D"). See FIG. 1. In another embodiment, depth of base 30 (measured from corner 32 to end of back region 31) is user defined, but generally depends upon a depth of a rough opening in a roof. It is contemplated that a depth of base 30 may range from approximately 1 inch to and including approximately 12 inches. In a preferred embodiment, depth of base 30 is approximately 5 5/16 inches. Length of a base 30 is user defined but generally depends upon a width of a rough opening at a lower region ("W"). See FIG. 1. In one embodiment of the present invention, depth of a base 30 is wider than a depth of a lower region of a rough opening ("D") in a wall when a corner 34 is in contact with a turn of a horizontal surface to a vertical surface of a rough opening's lower region. In another embodiment of the present invention, length of base 30 is longer than a width of a rough opening at a lower region (L"). In either circumstance where length or depth of a base 03 is greater than the corresponding dimension of a rough opening in a wall, then a user has the option to remove excess durable resilient material when a threshold gasket assembly 10 or a back dam has been installed, or even after a sill assembly 05 has been installed on a threshold gasket assembly 10. In such circumstance, user removal of such excess durable resilient material is achieved with a blade or shears. In another embodiment, excess base 30 can be turned up and fixed to a back dam, with any free excess (e.g. base 30 not fixed to foundation or back dam) removed with a blade or shears.

In one preferred embodiment, base 30 has a sloped upper region 36 when compared with its lower region 38. See FIGS. 2 and 3. The sloped or tapered upper region 36 promotes the direction of water, moisture, or a combination thereof positively away from an interior region of a structure. In a preferred embodiment, thickness of base 30 at a back region 31 is approximately 1/8 of an inch and thickness of base 30 near corner 32 is approximately 1/16 of an inch. In another preferred embodiment, thickness of base 30 is greater at a turn or corner 32 of the "L" cross section to increase a threshold gasket assembly's 10 durability, especially when left exposed and/or not covered by a sill assembly 05. See FIGS. 2 and 3. In a preferred embodiment, corner 32 has a thickness of approximately the same thickness as back region 31. In another preferred embodiment, corner 32 has a thickness of approximately the same thickness as the short portion of the "L" shaped base 30.

A preferred embodiment of a threshold gasket assembly as depicted in FIGS. 1 through 6, comprises a plurality of fins 20 running parallel to a longitudinal axis of a base 30 to form a corresponding plurality of channels 40. Each fin 20 acts as a dam to prevent or at least reduce water, moisture, or a combination thereof from travelling across a depth ("D") of a lower region of a rough opening in a wall. See FIG. 1. Each channel 40 directs or at least guides water, moisture, or a combination thereof to at least one end region 33 of a threshold gasket assembly 10. See FIG. 1. In one embodiment of the present invention, at least one fin 20 is fabricated from a durable material that is at least water resistant, and preferably waterproof. In another embodiment, at least one fin 20 is fabricated from a durable material that is also pliable such as, but not limited to, the materials described above. In a preferred embodiment, at least one fin 20 is fabricated from the same material as base 30. In yet another embodiment, at least one fin 20 and base 30 are unitary and extruded from the same material source. In yet another embodiment, at least one fin 20 is fixed, fitted, coupled or a combination thereof to base 30 thereby allowing installation and/or removal of a fin 20 from base 30.

As shown in FIGS. 1 through 6, fins 20 can be generally perpendicular, angled, or a combination thereof to an upper surface 36 of base 30. In a preferred embodiment, fins 20 extend at an angle from surface 36 (e.g. fin angle "A") ranging from and including approximately 10 degrees to and including approximately 90 degrees. In a preferred embodiment, fin angle "A" ranges from and including approximately 30 degrees to and including approximately 60 degrees. In yet another preferred embodiment, fin angle "A" is approximately 45 degrees. It is further contemplated that fin angle "A" can be uniform or vary from one fin 20 to another. Compare fins 20 of FIG. 2 with fins 20 of FIGS. 3 and 4.

The present invention contemplates the length of any given fin 20 (measured from root 34 to a tip 35) ranges from and includes approximately 5/32 inches to and including approximately 1/2 inches. In a preferred embodiment, at least one fin 20 has a length no greater than a maximum width of an adjacent channel 40. It is further contemplated that a threshold gasket assembly 10 may have fins 20 of different or similar lengths. See FIGS. 2 and 5.

As depicted in FIGS. 1 through 6, each fin 20 and adjacent fins 20 are sufficiently spaced from each other to prevent contact when one or both adjacent fins 20 are deflected or bent over. See FIG. 3. Such spacing of fins 20 simultaneously allows a deflected fin 20 to continue functioning as a dam and a channel 40 to positively direct water, moisture, or a combination thereof to at least one end region 33 of a threshold gasket assembly 10. Furthermore, a fully deflected fin 20 in contact with an upper surface 36 simultaneously allows a fin tip 35 to function as a dam and a remainder fin 20 to function as a contact gasket between a sill assembly 05 and foundation 03. See FIG. 3. The present invention contemplates a novel placement and spacing of fins 20, channels 40, or a combination thereof to provide a seal between sill assembly 05 and foundation 03 and simultaneously collect and positively direct water, moisture, or a combination thereof to at least one end region 33, an exterior region of a rough opening, or a combination thereof, irrespective of the shape or contour of a sill assembly's 05 lower surface. See FIG. 3.

Figure 4:
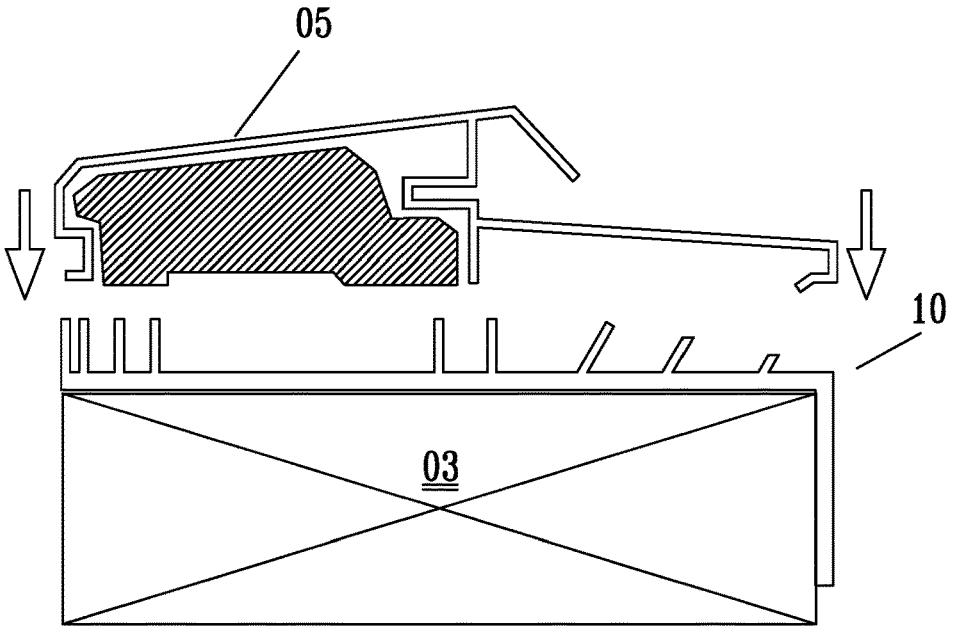
FIG. 4 is an elevation exploded view of a sill and a novel threshold gasket assembly with a plurality of angled and generally perpendicular fins extending from a base having a generally "L" shaped cross section.
Figure 5:
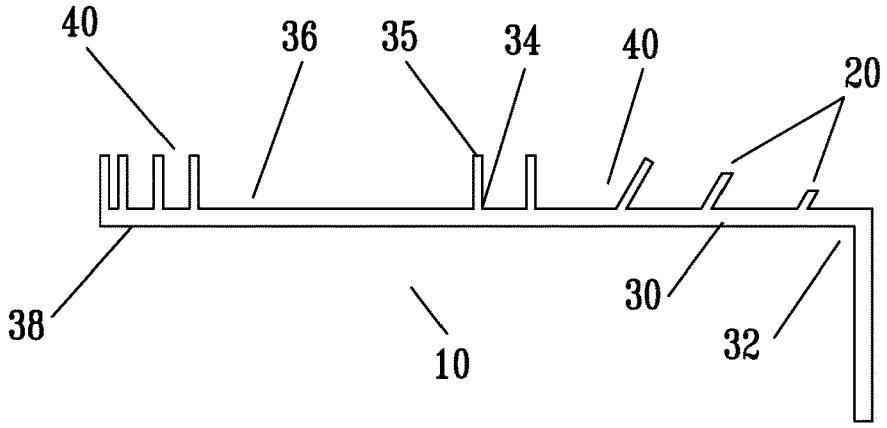
FIG. 5 is an elevation view of a threshold gasket assembly with a plurality of angled and generally perpendicular fins extending from a base having a generally "L" shaped cross section.
Figure 6:
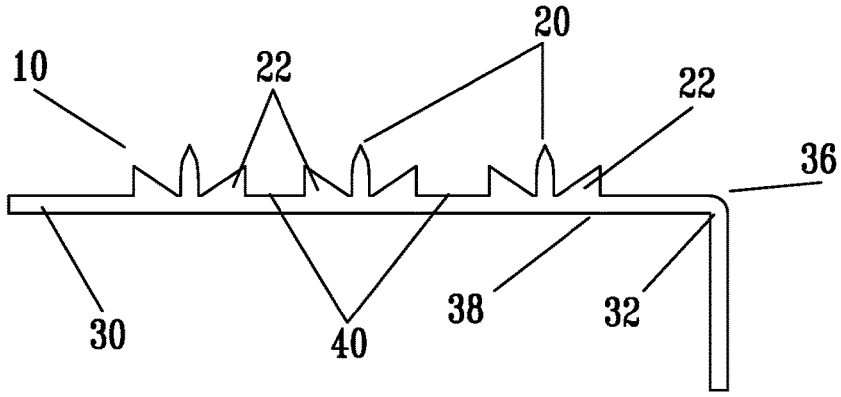
FIG. 6 is an elevation view of a novel threshold gasket assembly with a plurality of ribs and generally perpendicular fins extending from a base having a generally "L" shaped cross section.

As depicted in FIG. 4, the present invention contemplates a plurality of fins 20 being grouped to form a plurality of corresponding channels 40 with different widths. Such fin 20 grouping can be user defined to optimize contact between fins 20 and a lower surface of a sill assembly 05. See FIGS. 4 and 5.

In yet another embodiment of the present invention, at least one rib 22 is positioned adjacent to at least one fin 20 to arrest deflection of a fin 20 beyond a user defined angle. See FIG. 6. In one embodiment, at least one rib 22 arrests deflection of an adjacent fin 20 to approximately 80 degrees measured from a vertical axis. In another embodiment, at least one rib 22 arrests deflection of an adjacent fin 20 to approximately 10 degrees measured from a vertical axis. In a preferred embodiment, at least one rib 22 is positioned on base 30 to index a sill assembly 05 upon a threshold gasket assembly 20. See FIG. 6.

Installation of the present invention as part of installing a sill assembly 05 includes the steps of: applying a user defined length of threshold gasket assembly 10 upon a foundation 03 of a rough opening in a wall; fixing end regions 33 and back region 31 of threshold gasket assembly 10 to corresponding end dams and back dam to form a sill pan assembly that exceeds or at least meets ASTM Type IV sill pan requirements; and installing a sill assembly 05 upon threshold gasket assembly 10.

Although the present invention and its advantages have been described in detail, it should be understood that various changes, substitutions and alterations can be made herein without departing from the spirit and scope of the invention as defined by the claims set forth below.

SEQUENCE LISTING

Not applicable.

The invention claimed is:

1. A threshold gasket assembly positioned between a sill assembly and a foundation comprising:

at least two pliable fins, each extending away from a base to form a waterproof channel simultaneously promoting direction of water, moisture or a combination thereof away from an interior region of a structure and protecting the foundation from effects of water damage, wherein said base has a generally "L" shaped cross section and at least one of said pliable fins has a length no greater than a maximum width of said channel; and a rib positioned in said channel to arrest deflection of one of said fins beyond a pre-defined angle to said base between approximately 10 degrees and approximately 90 degrees.

2. A threshold gasket assembly as claimed in claim 1, wherein at least one of said pliable fins extends at an angle away from said base.

3. A threshold gasket assembly as claimed in claim 1, wherein deflection of at least one of said pliable fins results in contact with a portion of said base.

4. A threshold gasket assembly as claimed in claim 1, wherein said rib indexes placement of the sill assembly upon said base.

5. A threshold gasket assembly as claimed in claim 1, wherein an upper surface of said base is sloped away from an interior space.

* * * * *